US009168441B2

(12) United States Patent
Coombs

(10) Patent No.: US 9,168,441 B2
(45) Date of Patent: Oct. 27, 2015

(54) GOLF TOWEL TRANSPORT AND RETRIEVAL

(71) Applicant: Jack Alton Coombs, Horseheads, NY (US)

(72) Inventor: Jack Alton Coombs, Horseheads, NY (US)

( * ) Notice: Subject to any disclaimer, the term of this patent is extended or adjusted under 35 U.S.C. 154(b) by 0 days.

(21) Appl. No.: 14/293,268

(22) Filed: Jun. 2, 2014

(65) Prior Publication Data

US 2014/0274477 A1 Sep. 18, 2014

Related U.S. Application Data

(63) Continuation of application No. 12/838,696, filed on Jul. 19, 2010, now abandoned.

(60) Provisional application No. 61/308,393, filed on Feb. 26, 2010.

(51) Int. Cl.

| | |
|---|---|
| ***A63B 57/00*** | (2015.01) |
| ***A63B 55/00*** | (2015.01) |
| *A63B 47/04* | (2006.01) |

(52) U.S. Cl.

CPC ..... *A63B 57/0087* (2013.01); *A63B 55/007* (2013.01); *A63B 47/04* (2013.01); *A63B 2047/043* (2013.01); *A63B 2209/10* (2013.01); *Y10T 29/49826* (2015.01)

(58) Field of Classification Search

CPC ..... A63B 57/0087; A63B 55/007; A63B 2047/043; A63B 2209/10; A63B 47/04; Y10T 29/49826

See application file for complete search history.

(56) References Cited

U.S. PATENT DOCUMENTS

| | | | | | |
|---|---|---|---|---|---|
| 1,314,171 | A | * | 8/1919 | Vogel | 206/315.2 |
| 1,876,134 | A | * | 9/1932 | Clawson | 206/315.6 |
| 1,951,492 | A | * | 3/1934 | Schneider | 206/315.2 |
| 2,024,484 | A | * | 12/1935 | Smith | 294/146 |
| 2,489,958 | A | * | 11/1949 | Douglass | 294/19.2 |
| 2,763,309 | A | * | 9/1956 | Jones | 206/315.6 |
| 2,791,255 | A | * | 5/1957 | Ogden | 294/143 |
| 3,534,795 | A | * | 10/1970 | Wiedenmeier | 206/315.6 |
| 4,932,523 | A | * | 6/1990 | Yamazoe | 206/315.6 |
| 5,553,707 | A | * | 9/1996 | Lion | 206/315.9 |
| 5,597,363 | A | * | 1/1997 | Leote | 473/282 |
| 5,871,105 | A | * | 2/1999 | Whitehead et al. | 211/14 |
| 5,984,395 | A | * | 11/1999 | Halpen | 294/143 |
| 6,352,154 | B1 | * | 3/2002 | Miura | 206/315.6 |

* cited by examiner

*Primary Examiner* — Tri Mai

(57) ABSTRACT

A golf towel transport and retrieval apparatus may comprise a receptacle operable to accept at least a portion of a golf club head and one or more attachment points operable to attach to a towel.

2 Claims, 3 Drawing Sheets

GOLF TOWEL TRANSPORT AND RETRIEVAL

CROSS-REFERENCE TO RELATED APPLICATIONS

The present application claims the benefit of U.S. Provisional Patent Application No. 61/308,393, filed on Feb. 26, 2010, which is incorporated herein by reference in its entirety.

BACKGROUND OF THE INVENTION

The present invention generally relates to golf accessories, and more particularly, to a golf towel transport and retrieval system that may make the process of cleaning golf balls during the course of a golf game easier and more convenient.

Currently, during the course of a golf game, a golf ball that has been played onto the putting green area of a golf course usually has its position on the putting green marked before the golf ball is lifted from the putting green surface.

The lifting of golf balls played onto the putting green helps to provide an unobstructed putting line for other golfers while also providing an opportunity to clean the golf ball of any dirt or refuse that may have accumulated on the surface of the golf ball during the course of play. By cleaning their golf ball of any accumulated dirt or refuse, a golfer may prevent the dirt or refuse from unpredictably affecting the path of their golf ball when it is putted on the putting green.

While professional golfers usually have a caddy that will clean their golf ball for them, amateur golfers are usually forced to clean their own golf ball. However, because carrying, using, and retrieving a towel used for cleaning a golf ball may be inconvenient, many amateur golfers may decide to forgo the opportunity to clean their golf ball, thus putting themselves at a disadvantage by leaving dirt or refuse on their golf ball.

As can be seen, there is a need for an apparatus and/or a method to more quickly and easily clean their golf ball during the course of a golf game.

SUMMARY OF THE INVENTION

In one aspect of the present invention, an apparatus comprises a receptacle operable to accept at least a portion of a golf club head; and one or more attachment points operable to attach to a towel.

In another aspect of the present invention, a method for forming an apparatus comprises forming a receptacle between a first end plate and a second end plate, the receptacle being able to accept at least a portion of a golf club head; and attaching one or more attachment points to one or more of the first end plate and the second end plate, the one or more attachment points operable to attach to a towel.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a golf towel transport and retrieval apparatus that may help a golfer to more easily and quickly clean his golf ball on a golf course in the course of playing a golf game than by transporting a towel by hand. Embodiments of the present invention may be marketed under the name GREENSCADDY™.

Figure 1:
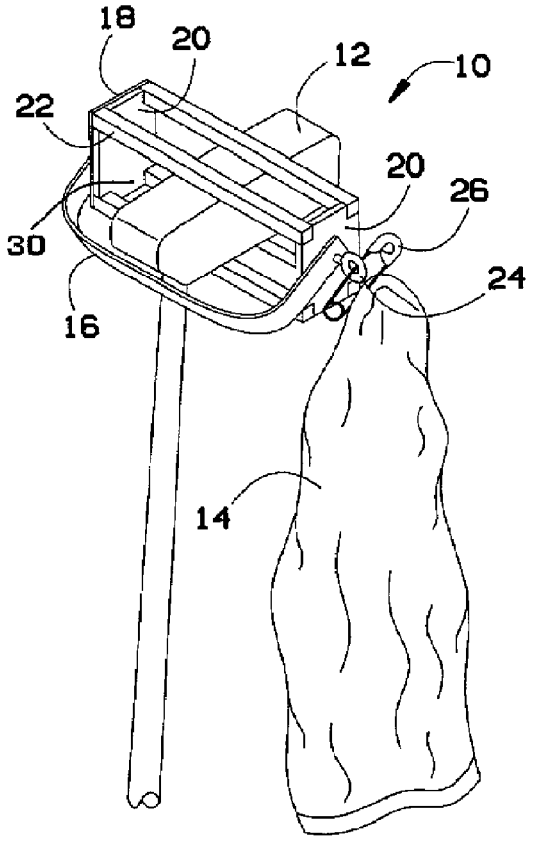
FIG. 1 shows a perspective view of a golf towel transport and retrieval apparatus in use in transport mode without a club head cover.
Figure 2:
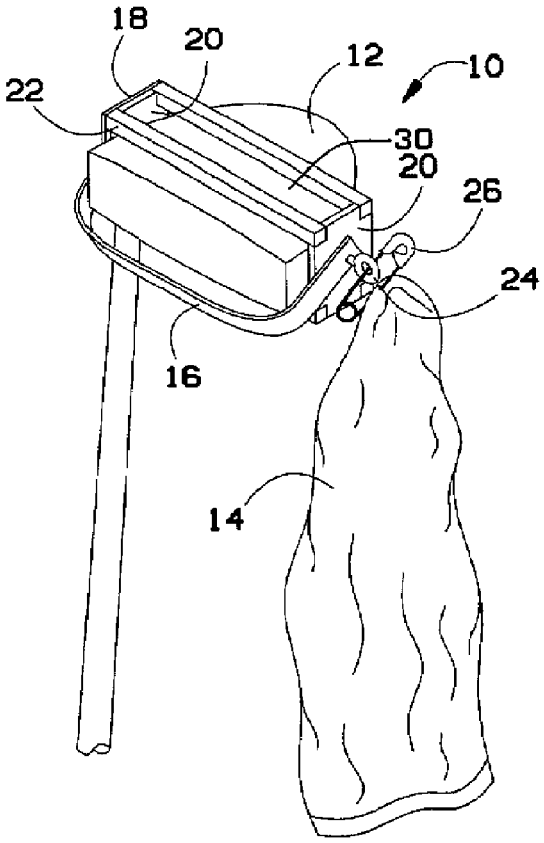
FIG. 2 shows a perspective view of the golf towel transport and retrieval apparatus of FIG. 1 in alternate use in transport mode without a club head cover.
Figure 3:
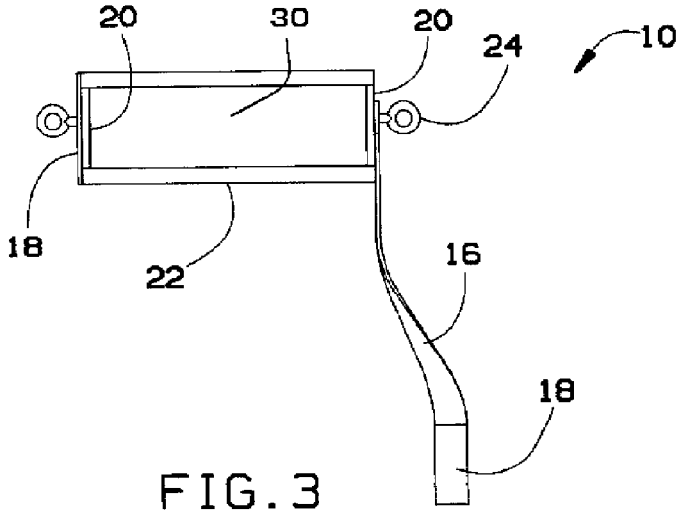
FIG. 3 shows a side elevation view of the golf towel transport and retrieval apparatus of FIG. 1.

With reference to FIGS. 1 to 3, a golf towel transport and retrieval apparatus 10 may have a towel 14 attached to it, and the apparatus may be attachable to the club head of a golf club 12, such as a putter, wood, iron, wedge, driver, or any other type of golf club. A golfer that wishes to clean his golf ball on the putting green may simply attach the head of his golf club 12 to the apparatus 10 to conveniently take the towel 14 attached to the apparatus 10 to his golf ball on the putting green.

When the golfer reaches his ball on the green, the golfer may mark the ball, lift the ball to allow his playing partners an unobstructed shot, and use the towel 14 attached to the apparatus 10 to clean any dirt or debris on the surface of his ball. When it is the golfer's turn to putt, he may place the ball back where he had marked it, he may detach the apparatus 10 from the golf club 12, he may place, drop, or throw the apparatus 10 onto the playing surface, and he may putt his ball using the now-freed golf club 12.

After the golfer has finished his or her putt, the golfer may easily retrieve the apparatus 10, without needing the golfer to bend or squat down, by engaging the apparatus 10 with the putter 12 and subsequently reattaching the putter 12 to the apparatus 10 with the strap 16, or alternatively reinserting the putter 12 into the club head cover 28 if so equipped.

The golf towel transport and retrieval apparatus 10 may include four stringers 22 that connect a pair of end panels 20 to create a structure, such as a rectangular box structure, that acts as a receptacle 30 between the pair of end panels 20 and one or more of the stringers 22 that may accommodate a club head of a golf club 12. A strap 16 may also be attached to each end panel 16 so that the strap 16 may be used to secure the apparatus 10 with a club head of a golf club 16 inserted into the receptacle 30 in the apparatus 10. One or more of the ends of the strap 16 may be a hook and loop fastener 18, such as VELCRO ™, so that one or more ends of the strap 16 may be detachable from and re-attachable to the end panels 20.

The apparatus 10 may also include one or more eye screws 24 attached, such as by screws and bolts, to one or more of the end panels 20. The eye screws 24 may be used as attachment points to attach the towel 14 to the apparatus 10 via a pin 26 that may fasten the towel 14 to one of the eye screws 24.

To attach a golf club 12 to the apparatus 10, the strap 16 may be disconnected from one of the end panels 20. The club head of the golf club 12 may be inserted into the receptacle 30 on the apparatus 10 between the end panels 20. The strap 16 may then be reattached to the previously disconnected one of the end panels 20 to secure the club head of the golf cub 12 to the apparatus 10.

To disengage the golf club 12 from the apparatus 10, the strap 16 may be disconnected from one of the end panels 20, and the club head of the golf club 12 may be removed from the receptacle 30 of the apparatus 10.

Figure 4:
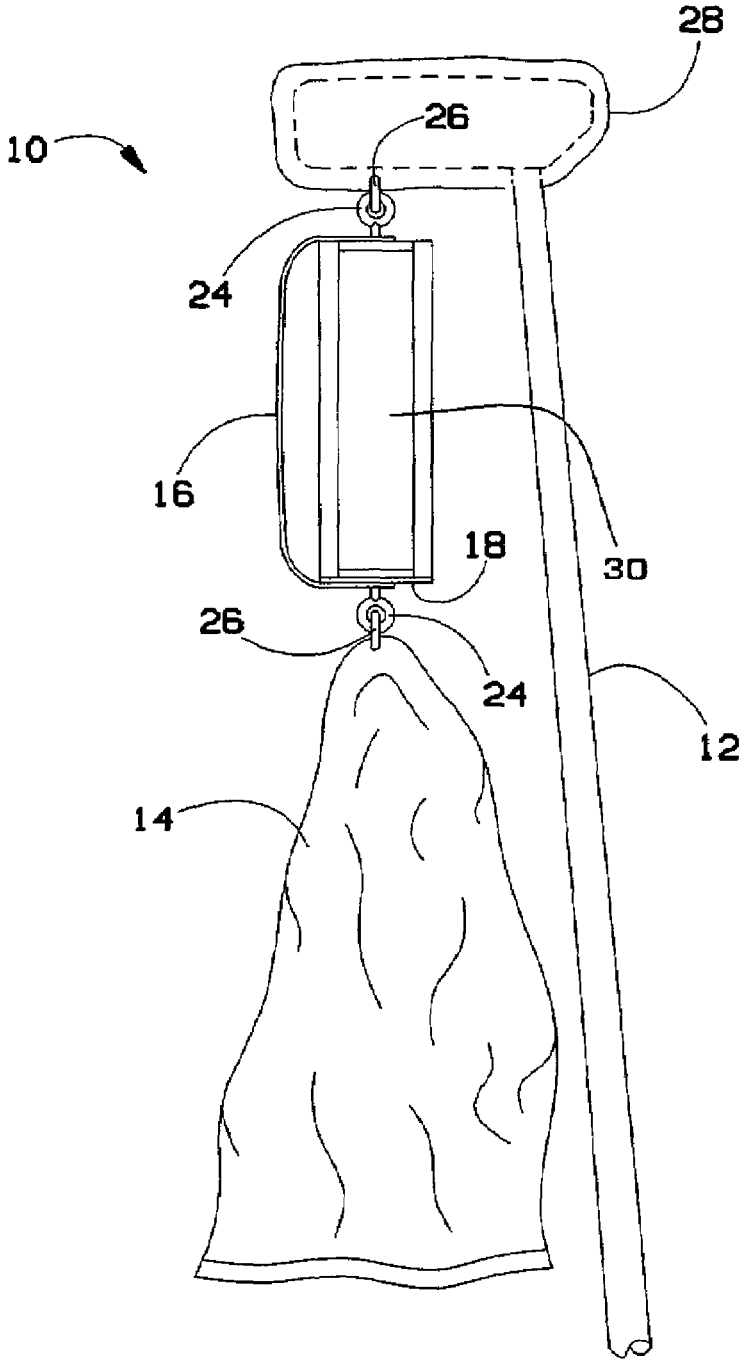
FIG. 4 shows a side elevation view of an alternate embodiment of the golf towel transport and retrieval apparatus of FIG. 1.
Figure 5:
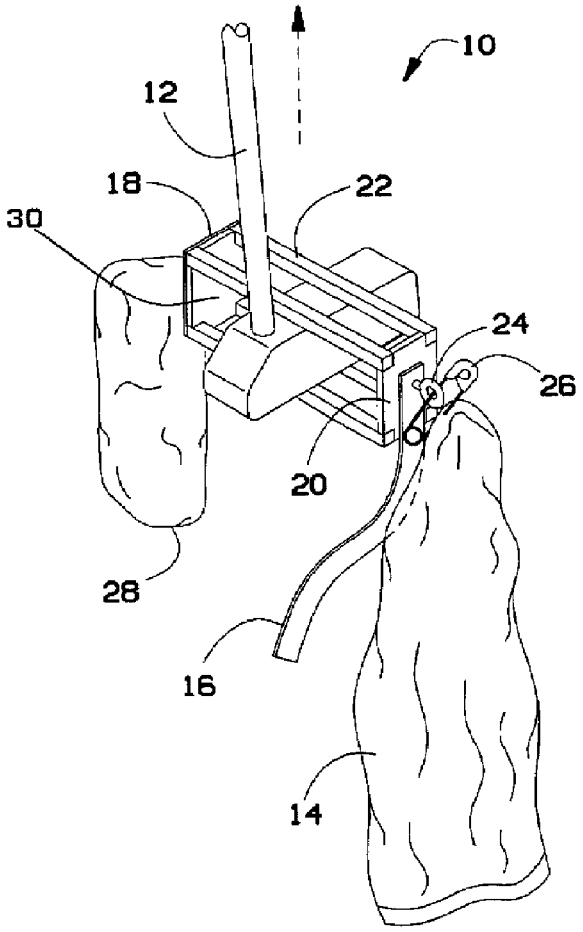
FIG. 5 shows a perspective view of the golf towel transport and retrieval apparatus of FIG. 1 in retrieval mode.
Figure 6:
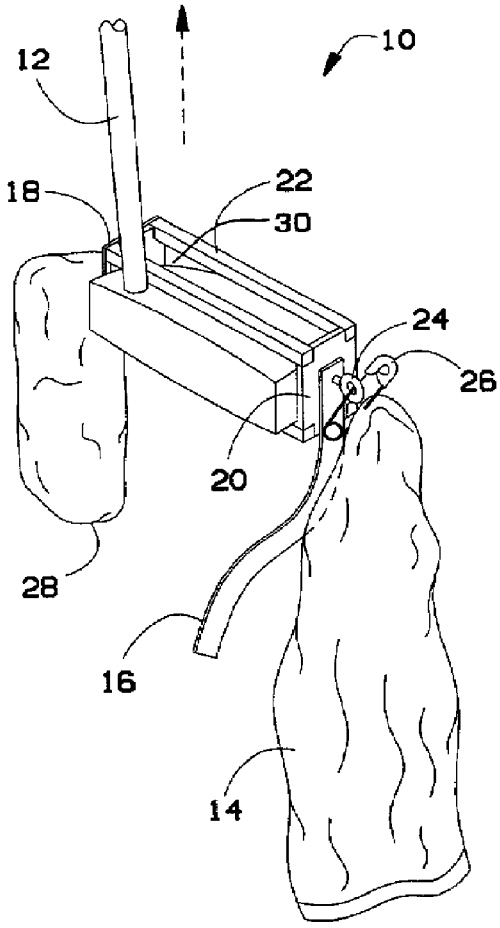
FIG. 6 shows a perspective view of the golf towel transport and retrieval apparatus of FIG. 1 in an alternate golf club retrieval mode.

With reference to FIGS. 4-6, a golf club head cover 28 may also be attached to the apparatus 10 via a pin 26 that may fasten the golf club head cover 28 to one of the eye screws 24. Thus, an apparatus 10 may have a towel 14 attached to one end panel 20 and a golf club head cover 28 to another end panel 20. The golf club head cover 28 may be used as an alternative way to attach a golf club 12 to the apparatus 10 by inserting the club head of the golf club 12 into the golf club head cover 28.

The components of the apparatus 10 may be made of any material that is of suitable strength, weather resistance, and club head abrasion protection. The stringers 22 may be square or may be of any cross sectional design, such as but not limited to a circular or oval shape. The end plates 20 may be square, but may not be limited to a circular or triangular design. The end plates 20 may be attached to the stringers 22 via adhesives, screws, or any other suitable method. Alternatively, the stringers 22 and the end plates 20 may be formed in one piece such as, but is not limited to, injection molding or any other forming techniques.

The apparatus 10 may be made by forming a receptacle 30 from the end plates 20 and the stringers 22 so that the end plates 20 and the stringers 22 may govern the depth of entry of a club head of the golf club 12 into the formed receptacle 30. The eyelet screws 24 may be mounted to the end plates 20 so that they are near the center of each end plate 20. The strap 16 may be attached to the end plates 20. The towel 14 and the golf club head cover 28 may be attached to the eyelet screws 24 via pins 26.

It should be understood, of course, that the foregoing relates to exemplary embodiments of the invention and that modifications may be made without departing from the spirit and scope of the invention as set forth in the following claims.

What is claimed is:

1. A method of retrieving a towel, comprising:

providing a retrieval apparatus comprising:

a rigid receptacle shaped to receive a golf club head, the receptacle comprising two end plates;

a strap connectable to the two end plates; and a towel connected to at least one of the strap and the end plates;

providing a golf club;

inserting a head of the golf club into the receptacle while the retrieval apparatus rests on a golf green;

lifting the retrieval apparatus with the golf club; and securing the head of the golf club into the retrieval apparatus with the strap.

2. The method as claimed in claim 1, wherein the receptacle further comprises a plurality of stringers attaching the two end plates, wherein the receptacle has a shape of an approximately rectangular box.

* * * * *